United States Patent [19]

Mitsui et al.

[11] 4,182,240

[45] Jan. 8, 1980

[54] PRINTER CONTROL ASSEMBLY

[75] Inventors: Yoshihiro Mitsui; Tadayoshi Shimodaira, both of Shiojiri, Japan

[73] Assignee: Shinshu Seiki Kabushiki Kaisha, Tokyo, Japan

[21] Appl. No.: 828,685

[22] Filed: Aug. 29, 1977

[30] Foreign Application Priority Data

Aug. 27, 1976 [JP] Japan ..... 51-102496
Jan. 24, 1977 [JP] Japan ..... 52-6525

[51] Int. Cl.[2] ..... B41J 1/44
[52] U.S. Cl. ..... 101/99; 101/93.22
[58] Field of Search ..... 101/93.29–93.48, 101/95, 99, 110, 111

[56] References Cited

U.S. PATENT DOCUMENTS

| | | | |
|---|---|---|---|
| 3,699,884 | 10/1972 | Marsh et al. | 101/111 |
| 3,750,565 | 8/1973 | Hubbard et al. | 101/111 X |
| 3,858,506 | 1/1975 | Frost | 101/99 X |
| 3,998,312 | 12/1976 | Fujimi et al. | 101/110 |
| 4,050,374 | 9/1977 | Check | 101/110 X |
| 4,054,089 | 10/1977 | Okabe | 101/99 |

OTHER PUBLICATIONS

IBM Tech. Discl. Bulletin, vol. 15, No. 5, 10/72, pp. 1410–1411, Hahn, "Print Wheel Control Mechanism".

*Primary Examiner*—Edward M. Coven

*Attorney, Agent, or Firm*—Blum, Kaplan, Friedman, Silberman & Beran

[57] ABSTRACT

A small sized printer wherein the duration of the print cycle and the sequence of printing operations, during a print cycle, is controlled. The printer includes a plurality of print characters circumferentially disposed therearound, the print characters being selectively positioned in a print position by rotating the print ring from a rest position to a print position during each print cycle. A motor is adapted to be energized to rotate the print rings from a rest position to a print position during each print cycle. The instant invention is particularly characterized by a detection arrangement for detecting the rotary position of the print rings and generating a character selection timing signal representative of each of the rotational positions of the print ring. A print selection arrangement is associated with each of the print rings for selectively positioning same at predetermined print positions during each print cycle in response to the character selection timing signal produced by the detection arrangement being applied thereto. The detection arrangement is further adapted to detect the rotary position of the print rings and generate a reference signal that is distinct from the character position timing signal produced during each print cycle, the motor being utilized to rotatably drive the print rings being deenergized in response to the reference signal being applied thereto.

12 Claims, 22 Drawing Figures

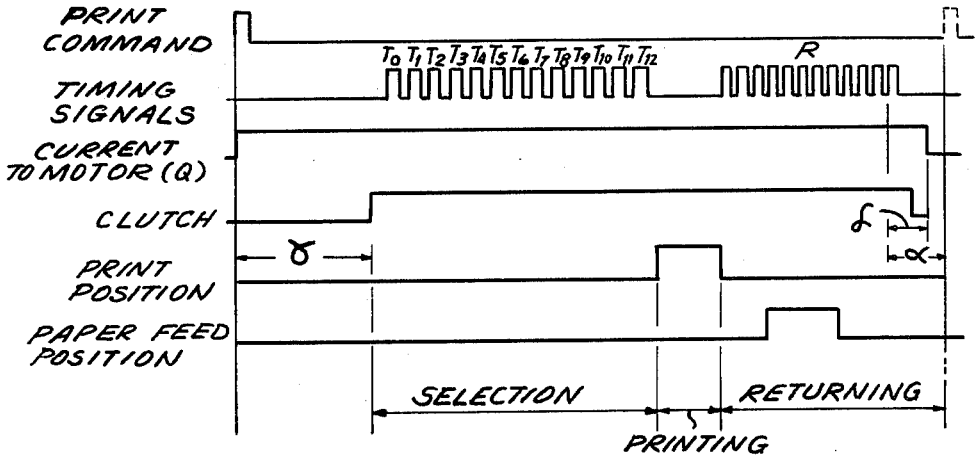
FIG. 4
PRIOR ART
FIG. 9
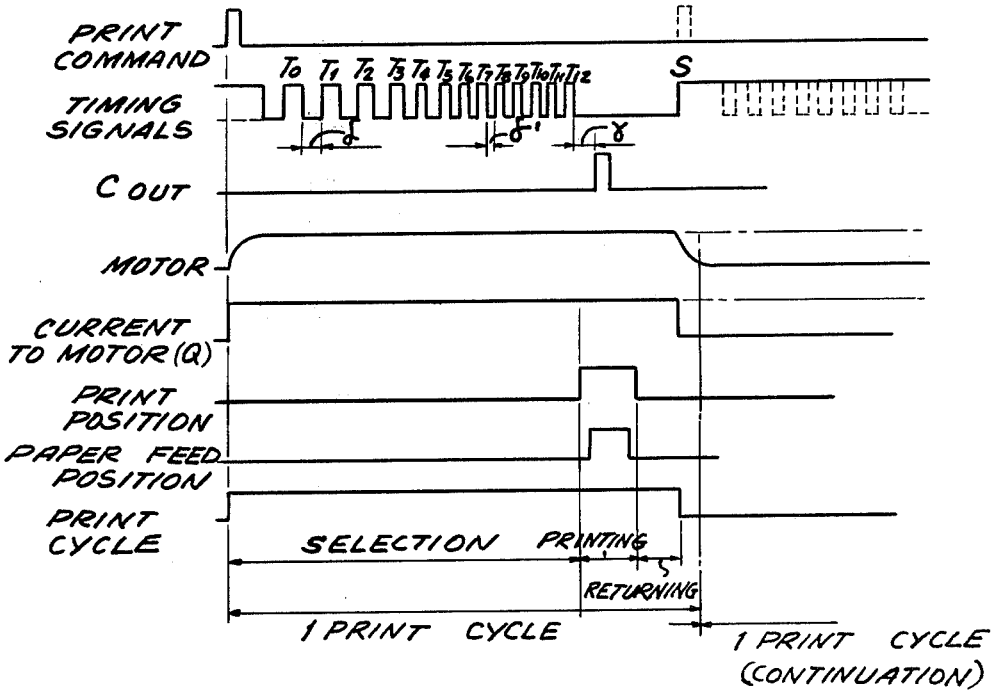

FIG. 12a
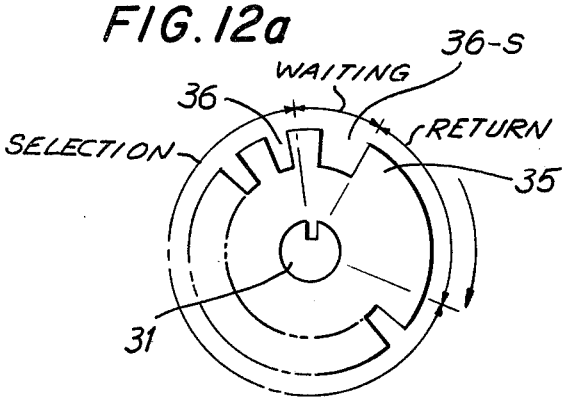
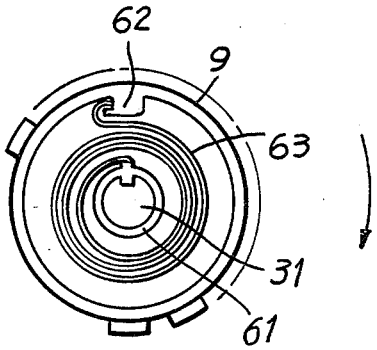
FIG. 12b
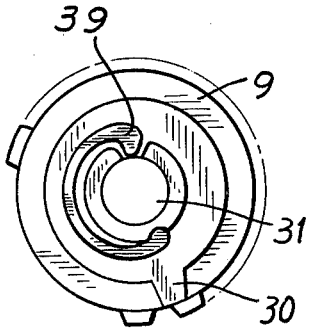
FIG. 13

PRINTER CONTROL ASSEMBLY

BACKGROUND OF THE INVENTION

This invention is directed to a small sized printer of the type having a plurality of print rings with print characters circumferentially disposed therearound, and in particular to an improved detection and control arrangement for use with a small sized printer of the type utilized in a desk calculator, for controlling the duration of print cycle and sequence of printing, during each print cycle of the printer.

Miniaturized printers, of the type utilized to provide a permanent record in a desk calculator or other computing instruments, such as a cash register or the like, are characterized by the use of a drive motor that is energized during printing, and is deenergized when the printer is not in use. When the printer is in use, a supply voltage is applied to the drive motor to effect an energization of same for a complete printing cycle of the printer, which printing cycle includes the positioning of the print rings for printing, the printing operation, and the return of the print rings to a stand-by position wherein each of the print rings are aligned in a rest position so that the next printing cycle can be commenced.

Due to the rapid speed with which the information can be processed by small sized electronic instruments, such as desk calculators and the like, it is desired that the entire printing cycle of the printer be completed at higher speeds with greater accuracy and at less expense. Heretofore, printers of the prior art have utilized two distinct detector arrangements for controlling the print cycle of the printer. A first detector was utilized to detect the position of the print rings and selectively position the print rings in the print position, whereas the second detector was utilized to detect the rotary position of gears utilized to drive the print rings, and deenergize the motor utilized to drive the printer at the end of or just prior to the end of the print cycle. Accordingly, such prior art printers required a delay subsequent to the completion of the printing cycle, thereby causing a stand-by time between each printing cycle that substantially slows down the speed of the printer. Moreover, in prior art printers, the paper upon which the information is printed is usually advanced to permit reading of the printer characters at the completion of the printing cycle.

The aforenoted disadvantages obtain in several types of small sized printers of the print ring variety. For example, a first type of printer, in which such disadvantages occur and to which the instant invention is directed, is the type of printer wherein the shafts supporting each of the print ring returns each of the print rings to a rest position after printing, thereby by rotating the shaft supporting the print rings in the opposite rotational direction, so that the print rings are returned to a rest or stand-by position after each printing cycle. A second printer is of the type where the shaft supporting the print rings is rotated through a single revolution, and within the revolution permits each of the print rings to be selectively positioned in a print position, and thereafter rotated toward a rest or stand-by position at the end of the print cycle. The third type of printer arrangement to which the instant invention is directed, is where the shaft supporting the print ring is rotated through a first revolution to position the print rings at a print position, and then through a further revolution so that the print rings are returned to the rest or stand-by position. Heretofore, the three types of printer arrangements detailed above have utilized two distinct detectors, a first detector for producing print character signals, and a second and distinct detector for producing a stop signal for controlling the drive motor. Alternatively, a signal detector was used to produce the print character signals, with a clutch being utilized to control the operation of the drive motor. Accordingly, a single detector arrangement for use in a miniaturized printer that is capable of producing print character selection signals and also producing motor control reference signals is desired.

SUMMARY OF THE INVENTION

Generally speaking, in accordance with the instant invention, a small sized printer having an improved detection arrangement for controlling the duration of a print cycle and the sequence of printing operations performed thereby during each print cycle is provided. The printer includes a plurality of print rings having print characters circumferentially disposed therearound. The print characters are selectively positioned in a print position by rotation of each of the print rings in a first rotational direction from a rest position to a print position during each print cycle. A rotational drive arrangement, including a motor, is adapted in response to being energized to rotatably drive the print rings from a rest position to a print position during each print cycle. The invention is particularly characterized by a detection arrangement for detecting the rotational position of the print rings and for generating a character position timing signal representative of each of the rotational positions of the print rings, the rotational position of the print rings corresponding to a print character circumferentially disposed about the print rings. A print selector is associated with each of the print rings for selectively positioning each of the print rings at a respective predetermined print position during each print cycle in response to the character selection timing signal produced by the detector arrangement being applied thereto. The detector arrangement is further adapted to apply a reference signal that is distinct from the character selection timing signal to the drive motor, the drive motor becoming deenergized in response to the reference signal being applied thereto.

Accordingly, it is an object of the instant invention to provide a faster, more accurate and less expensive printer for use in a small sized electronic computing instruments, such as a desk calculator.

A further object of the instant invention is to provide an improved detecting arrangement for a printer that controls the duration of a print cycle and the sequence of printing operations effected during each printing cycle.

Still a further object of the instant invention is to provide a detection arrangement for a printer that eliminates the delays between the completion of a printing cycle and the commencement of the next printing cycle.

Still a further object of the instant invention is to provide an improved detecting arrangement for a printer that eliminates the stand-by time between consecutive printing cycles to thereby improve the accuracy and printing speed of the printer.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the description taken in connection with the accompanying drawings, in which:

FIG. 4 is a wave diagram illustrating the operation of a further printer constructed in accordance with the prior art;

FIG. 9 is a wave diagram illustrating the operation of the control circuitry depicted in FIGS. 10*a* and 10*b;*

FIGS. 12*a* and 12*b* illustrate a detection plate and a print wheel for use in a miniaturized printer constructed in accordance with still a further embodiment of the instant invention; and FIG. 13 is an elevational view of a print wheel for use with a detector assembly for a miniaturized printer constructed in accordance with still a further embodiment of the instant invention.

DETAILED DESCRIPTION OF THE PREFERRED EMBODIMENTS

Figure 1:
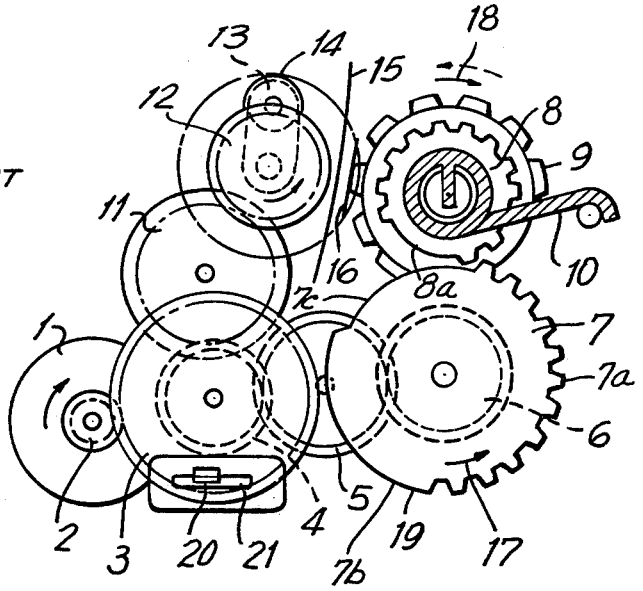
FIG. 1 PRIOR ART
FIG. 1 is an elevational view of the drive mechanism of a miniaturized printer constructed in accordance with the prior art.

Reference is now made to FIG. 1, wherein a conventional motor driven miniaturized printer having a two-detector arrangement is depicted. A drive motor 1 that is adapted to be rotated in a clockwise direction, when viewed in FIG. 1, when the drive motor is energized, and is stopped when the drive motor is deenergized, includes a driving gear 2 disposed in meshing engagement with a reduction gear 3. Reduction gear 3 is adapted to rotate one turn for each printing cycle and is coupled through power transmission gears 4, 5 and 6 and power transmission gear 11 to intermittent driving gear 7 and printing gear 12.

Intermittent driving gear 7 includes a plurality of gear teeth 7*a*, a non-tooth portion 7*b*, and a notched recessed portion 7*c* peripherally disposed therearound. The gear teeth 7*a* and remaining portions of the intermittent driving gear 7 are adapted to engage intermittent driven gear 8, which gear also has a portion 8*a* that is free of gear teeth. Gear 8 is mounted on a shaft that supports a plurality of print rings 9. Print rings 9 include a plurality of print characters 9' such as letters, numbers, symbols and the like, that are circumferentially disposed thereabout. A coil spring 10 is provided and includes a first end secured to intermittent gear 8 and the other end fixedly mounted to the frame (not shown) of the printer.

As noted above, printing gear 12 is driven by power transmission gear 11 and has the same rotational ratio as the intermittent driving gear 7, in order to effect synchronization therebetween. A crankshaft 13 is secured to the printing gear and supports a print roller 14 that is adapted to be rotated into and thereby sandwich a web of paper 15 and an ink ribbon 16 between the print roller and print characters formed on the print wheel to effect printing in the usual manner.

Figure 2:
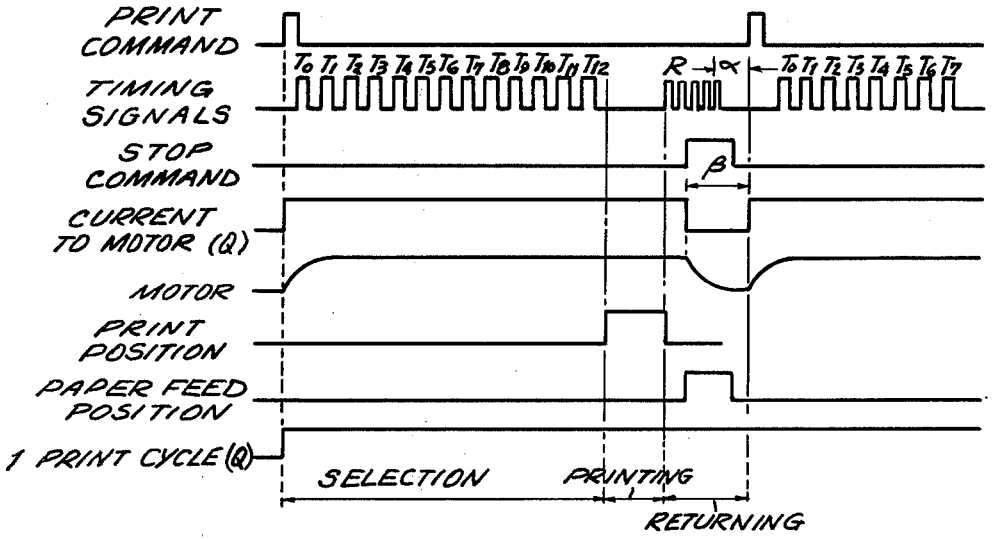
FIG. 2 PRIOR ART
FIG. 2 is a wave diagram illustrating the operation of the miniaturized printer depicted in FIG. 1.

By way of explanation of the operation of the printer, illustrated in FIG. 1, the printer is depicted in a stand-by condition. Referring to FIG. 2, when a PRINT COMMAND signal is applied to the printer, the drive motor 1 will be energized to thereby effect a rotation of the intermittent driving gear 7 in the direction (counterclockwise) of the arrow 17. The gear teeth 7*a*, on the intermittent driving gear 7, are immediately brought into meshing engagement with the teeth on the intermittent driven gear 8 to thereby effect a rotation of the intermittent driven gear in the direction (clockwise) of the arrow 18. Rotation of the intermittent gear in the direction indicated by the arrow 18, will effect a winding up of the portion of the coil 10 proximate to the end that is secured to the intermittent driven gear 8. As the intermittent driven gear 8 is rotatably driven by the intermittent driving gear 7, the print rings 9 will also be rotated and hence generate character timing signals $T_0$ through $T_{12}$. The character selection timing signals are applied to an appropriate character selection mechanism, including a plurality of selection pawls associated with each print ring to selectively position the respective print rings at print positions to effect printing thereby.

As the intermittent driving gear 7 continues to be rotated, and hence continues to rotate each of the print rings, each of the print rings are positioned in a print position whereby a character or the absence of a character is selected until an entire line of print is selected. Once each of the print characters are positioned, the portion of the intermittent driving gear 7*b*, not having any notches therein, is disposed in engagement with the last tooth on the intermittent driving gear 8 and, hence, maintains the shaft upon which same is disposed wound with the coil 10 therearound.

As aforenoted, the rotation of the print roller 14 is synchronized with the rotation of the intermittent gear 7. Accordingly, once each of the print rings 9 are selectively positioned in a print position, and further rotation of the intermittent driven gear 8 is prevented by the portion 7*b* of the intermittent driven gear 7, the print roller 14 will bring the paper web 15 and ink ribbon 16 into contact with the print characters to thereby effect a printing of the characters on the paper web. After printing is completed, the increased diameter portion of the intermittent driving gear 7 clears the teeth on the intermittent driven gear 8 leaving the recessed notch 8*a* in the path of the teeth of intermittent driven gear 8 and, hence, provides a clearance between the intermittent driven gear 8 and the intermittent driving gear 7. The clearance between gears 7 and 8 permits the intermittent driven gear 8 to be rotated in the counter-clockwise direction (as viewed in FIG. 1), and the uncoiling of the spring 10 to thereby return each of the print rings to a stand-by position. The return of the intermittent driven gear 8 to a stand-by position will result in each of the print rings being aligned in a rest position until the next print cycle is commenced. As detailed below, the timing signal utilized to control the operation of the printer is produced independently of the selection of the print characters, thus causing a return signal R to be produced and detected that has an unstable frequency.

The paper web 15 is advanced after printing thereon has been completed. Accordingly, the mechanical load of the printer and the inertia of the motor must be taken into consideration in controlling the paper feeding mechanism. To this end, a mechanical detecting arrangement including a magnet 20, disposed on reduction gear 3 and a lead switch 21 secured to the printer frame (not shown), provides a STOP COMMAND signal to the printer just prior to or immediately after the paper feeding is effected. The STOP COMMAND signal is utilized to interrupt the current applied to the drive motor 1 and electrically brake same, to thereby assure that the intermittent driving gear 7 is no longer rotated and is maintained at a stand-by position. When the drive motor 1 is deenergized, and hence stops rotating, the paper feeding operation is completed, the intermittent driven gear 8 and print rings 9 are returned to the stand-by position to prepare the printer to receive the next PRINT COMMAND signal and complete the printing cycle.

Figure 3A:
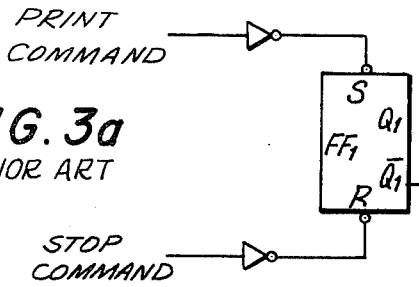
FIG. 3a PRIOR ART
FIGS. 3*a*–3*e* respectively illustrate control circuitry for controlling the operation of the miniaturized printer depicted in FIG. 1 during each print cycle thereof.
Figure 3B:
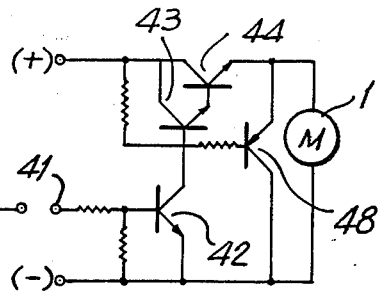
FIG. 3b PRIOR ART

The STOP COMMAND signal produced by the magnetic detector arrangement, illustrated in FIG. 1, is utilized with the control circuits, illustrated in FIGS. 3*a* through 3*e*, to effect control of the printing operation during each print cycle. As is illustrated in FIG. 3*a*, a PRINT COMMAND signal is applied to set terminal S of a flip-flop $FF_1$, and permits a LOW level output $\overline{Q}_1$ to be applied to the motor control circuitry and thereby permit the drive motor 1 to be energized. However, when a STOP COMMAND signal is applied to the reset terminal R of flip-flop $FF_1$, the flip-flop is reset and thereby applies a HIGH level signal $\overline{Q}_1$ to the control circuitry for the motor 1 to thereby deenergize the drive motor and brake same. Reference is made to FIG. 3*b*, wherein a drive motor control circuit, including a Darlington connection comprised of transistors 43 and 44, are coupled in series with the parallel connection of a drive motor 1 and shunt transistor 48 in order to control the amount of current applied to the drive motor when same is energized and shunt current across the shunt transistor 48, when it is desired to deenergize the drive motor 1. Specifically, the output $\overline{Q}_1$, of flip-flop $FF_1$, is applied to a control terminal 41 of the control circuit, to thereby control the conduction characterisic of transistor 42. When an energizing signal is applied to the control terminal 41 of the transistor 42, the shunt transistor 48 is turned OFF, thereby permitting the Darlington connection to control the speed of the drive motor 1. Alternatively, when a deenergizing signal is applied to the control terminal 41 of the control transistor 42, the shunt transistor 48 is turned ON, thereby shunting all the current applied to the drive transistor and, at the same time, turning OFF the transistors comprising the Darlington connection, to thereby effect a braking of the drive motor 1. Accordingly, the stop command signal, produced by the magnetic detection switch disposed on the reduction gear 3, is utilized to deenergize and brake the DC motor 1.

Figure 3C:
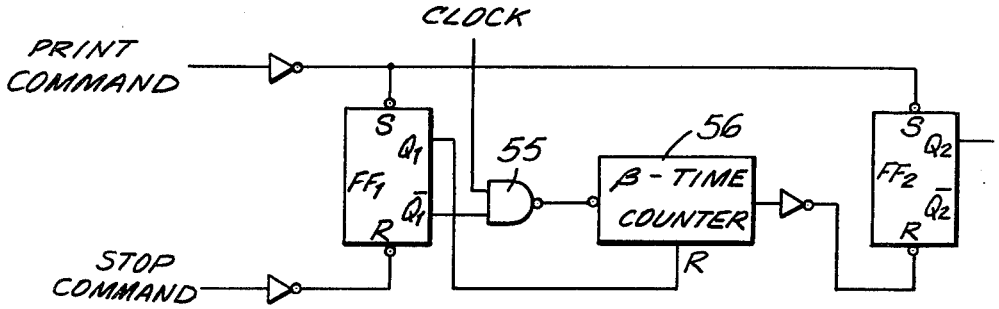
FIG. 3c PRIOR ART
Figure 3D:
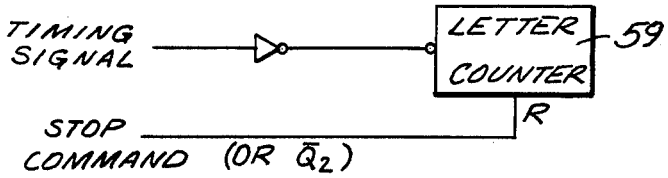
FIG. 3d PRIOR ART
Figure 3E:
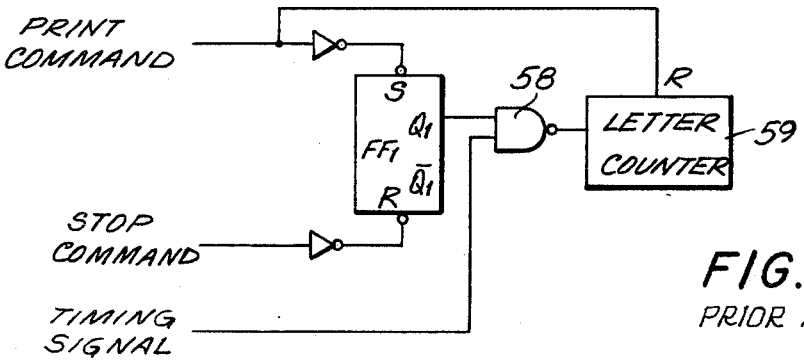
FIG. 3e PRIOR ART

Reference is now made to FIG. 3*c*, wherein the control circuitry for detecting the end of a printing cycle in the printer, depicted in FIG. 1, is depicted. As is illustrated in FIG. 2, the print cycle is terminated at an interval of time $\alpha$ after the trailing end of the signal R, generated by the print rings 9, or after a predetermined interval of time $\beta$-, after the leading edge of the STOP COMMAND signal by utilizing a $\beta$-time counter 56 to measure a $\beta$-time interval after the generation of the STOP COMMAND signal. By applying the STOP COMMAND signal to the reset terminal R of the flip-flop $FF_1$, the flip-flop is reset, thereby producing a HIGH level signal at the output $\overline{Q}_1$, which output is applied as a gating signal to NAND gate 55. Once a HIGH level gating SIGNAL is applied to the NAND gate 55, a clock signal is applied to the other input of the NAND gate 55 and is gated by same to $\beta$-time counter 56 to thereby index the $\beta$-time counter 56 through a predetermined counting cycle. At the end of the predetermined counting cycle, the $\beta$-time counter 56 will apply a reset pulse to the flip-flop $FF_2$ to thereby produce an end of cycle control signal. In FIGS. 3*d* and 3*e*, circuits utilized in conventional printers for synchronizing the selection of the print characters with the character selection signals are respectively depicted. For example, in FIG. 3*d*, a character selection timing signal is applied thereto to reset the letter counter. Such an arrangement assures that the letter counter is reset to zero before the next PRINT COMMAND signal is applied thereto, to begin the next print cycle. Alternatively, in FIG. 3*e*, the flip-flop $FF_1$ is utilized to control NAND gate 58, in order to effect gating of the timing signal until the STOP COMMAND signal resets the flip-flop $FF_1$. It is noted that the circuitry, depicted in FIG. 3*e*, permits the printer to be stopped when the printer is in other than a stand-by condition, if the current is interrupted during the operation of the printer, by assuring proper synchronization between the print characters or the print rings and the character selection signals $T_0$ through $T_{12}$.

It is noted that the use of a STOP COMMAND signal of the type produced by the magnetic detector arrangement and control circuitry therefor, depicted in FIGS. 3*a* through 3*e*, has several disadvantages. In addition to not being compatible with the design and layout of a printer, there is a considerable reduction in reliability because of the mechanical contacts in the lead switch and the greater number of elements including the lead switch, permanent magnet, etc., which raise the cost of assembly, repair and installation of the printer. Moreover, the use of a mechanical detector results in the duration of the print cycle being increased, and hence the speed of the printer being likewise increased. For example, when an astable multi-vibrator is utilized to produce a clock signal, the thermal characteristic thereof must be accounted for and, accordingly, the $\beta$-time interval must take into account all possible thermal deviations. Thus, the $\beta$-time interval must be maximized to avoid any deviation that may occur in the clock signal.

Reference is also made to FIG. 4, wherein a wave diagram illustrating the manner in which a printer having a clutch arrangement instead of a mechanical detector, of the type illustrated in FIG. 2, is depicted. A current is applied to the motor to thereby start same in response to a PRINT COMMAND signal being applied, and a clutch will be engaged after a preliminary predetermined $\gamma$-time interval. Accordingly, the operation of the clutch will only be initiated by energizing an electromagnet after a predetermined $\gamma$-time interval has elapsed. The shaft supporting the print rings will be rotated simultaneously with the engagement of the clutch to thereby produce character selection timing signals $T_0$ through $T_{12}$. The power supplied to the motor will be turned off by detecting a $\alpha$-time interval measured from the leading edge of the last return pulse R generated by the return of the printing rings to a rest position wherein same are aligned. The clutch is mechanically released before the power to the motor is turned off and the rotary shaft, supporting the print rings, is returned to a rest position. Accordingly, the print cycle is completed after an $\alpha$-time interval has elapsed. This prior art embodiment is characterized by the necessity of selecting an $\alpha$-time interval before the next print cycle can be commenced that is longer than the $\alpha$-time interval measured by the $\alpha$-time counter. The instant invention is therefore characterized by a detection arrangement that reduces the delay between printing cycles, and hence increases the speed of the printer.

Figure 5:
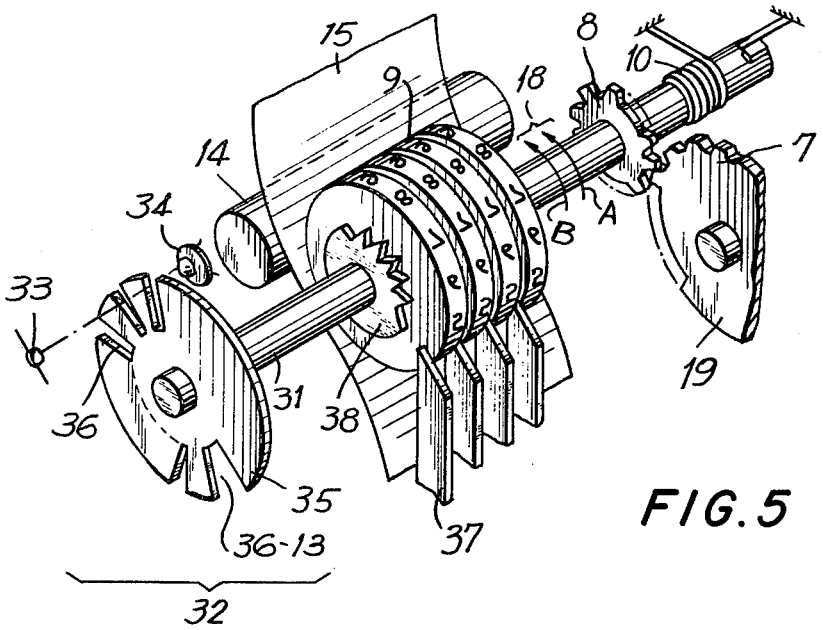
FIG. 5 is perspective view of a miniaturized printer including a detection assembly constructed in accordance with a preferred embodiment of the instant invention.

Reference is now made to FIG. 5, wherein a detection arrangement, constructed in accordance with the preferred embodiments of the instant invention, is depicted, like reference numerals being utilized to denote like elements described above. As in the conventional embodiment discussed above, the intermittent driving gear 7 engages the intermittent driven gear 8 and effects a rotation of the shaft 31 in the direction A indicated by the arrow 18. The rotation of the shaft 31, in the direction A of the arrows 18, results in a likewise rotation of the print rings 9 and a detecting plate 35 affixed to one end of the rotary shaft 31. The detecting plate 35 is a part of the detection assembly, generally indicated as 32. The detecting plate includes slit openings 36 to permit synchronization with the positioning of the characters on each of the print rings so that the position of each of the characters on the print ring will be detected by photo-diode 33, such as a luminescent diode, and a suitable photodetector 34, such as a photo-transistor, or the like. In response to the character selection timing signal produced by slits 36, a print select mechanism of the type well known in the art (not shown), will receive the character selection signal and trigger an electromagnet to thereby selectively position pawls 37 into engagement with the ratchet teeth of the ratchet gear 38, coupled to each of the print wheels, to thereby position the print wheel at a print position.

Once each of the print rings is selectively positioned at a print position, the intermittent driven gear is locked with the coil spring 10 in a wound position in the manner discussed above. The last slit 36-13 is considerably wider than the remaining slits 36 in the detecting plate to provide a HIGH level reference pulse having a considerably larger pulse width than the character selection timing signals produced when the print rings are being selectively positioned at different print positions.

Accordingly, the reference signal produced by the slit 36-13 is not produced until each of the print rings have been selectively positioned in a print position. The rotation of the print roller is synchronized with the rotation of the intermittent driving gear 7 in order to effect an engagement of the web and ribbon against the print characters by the print roller 14 when the print rings are prevented from rotating by the intermittent driving gear 7. Once the printing operation is completed, the intermittent driven gear 8 and intermittent driving gear 7 will be in a clearance position with respect to each other, to thereby permit the intermittent driven gear 8 to effect a return of the shaft 31 in the rotational direction B indicated by the arrows 18, and hence a return of the print rings 9 and detecting plate 35 to their rest or stand-by positions. Upon completion of the printing operation, and during the return of the print rings to a rest position, the paper web is advanced.

Figure 6:
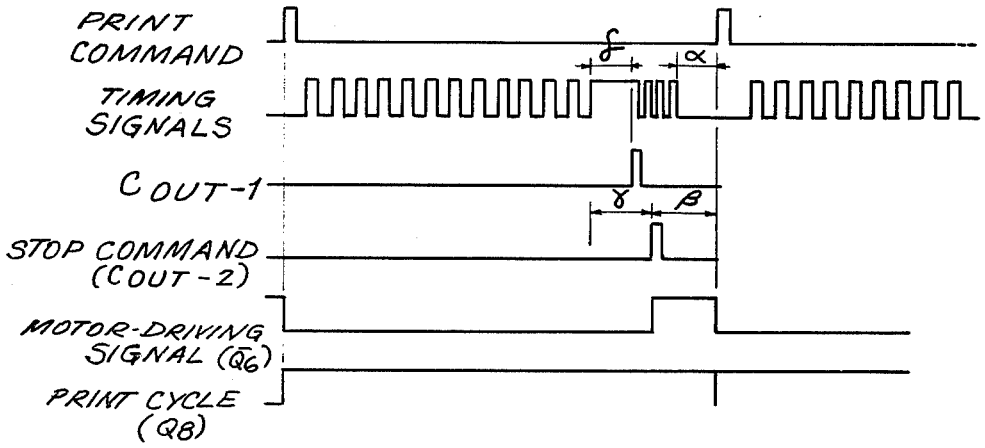
FIG. 6 is a wave diagram illustrating the operation of the miniaturized printer depicted in FIG. 5.
Figure 7A:
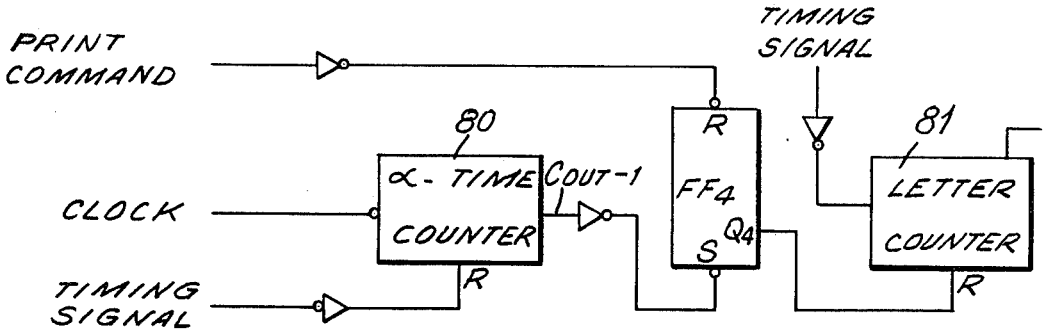
FIGS. 7*a*, 7*b* and 7*c* respectively illustrate control circuits for use with the miniaturized printer depicted in FIG. 5.
Figure 7B:
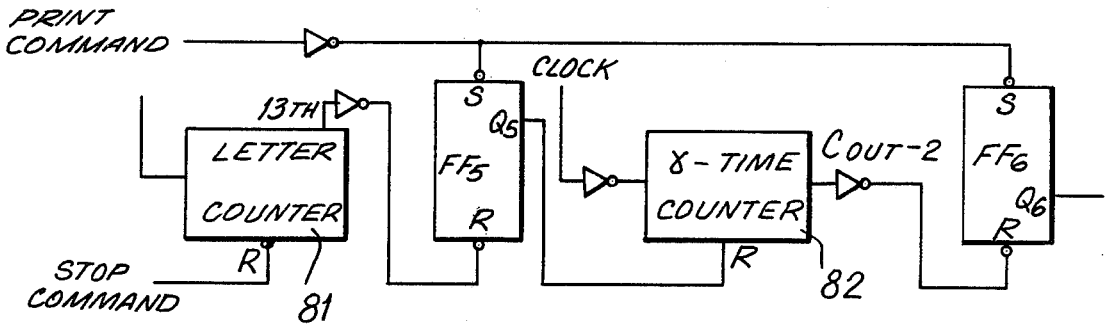
Figure 7C:
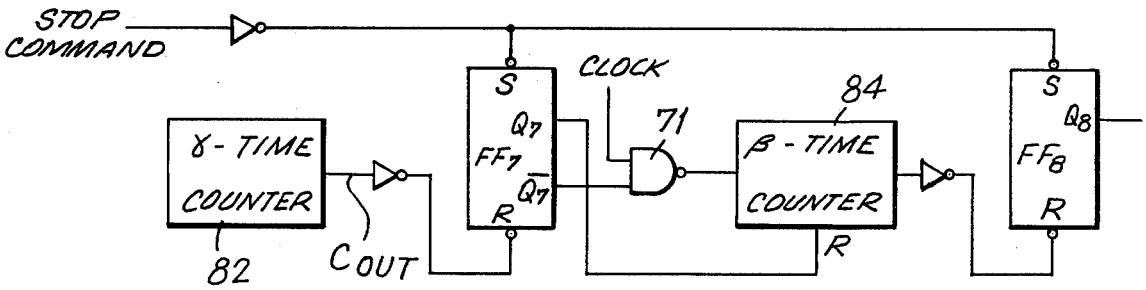

Reference is now made to the wave diagram, illustrated in FIG. 6, and the print cycle control circuitry, illustrated in FIGS. 7*a*, 7*b* and 7*c*, in order to illustrate the manner in which completion of each print cycle is controlled by a detection arrangement constructed in accordance with the instant invention, like reference numerals being utilized to denote like elements described above. Turning first to FIG. 7*a*, control circuitry for detecting the position of the print characters, disposed on the respective print rings, and for producing control signals that are synchronized with respect thereto is depicted. The thirteenth (13th) character selection timing signal, produced by the photo detector 33, is the large pulse width reference timing signal. The width of the slit 36-13 is selected in order to provide a reference signal having a pulse width that is larger than an $\alpha$-time interval. Accordingly, a $\alpha$-time counter 80 is provided for producing an output signal $C_{out\text{-}1}$ at a time interval $\alpha$ after the leading edge of the reference signal is applied thereto. The signal $C_{out\text{-}1}$ is applied to the set terminal of flip-flop $FF_4$ and sets the output $Q_4$ to a HIGH binary level, to thereby effect a resetting of the letter counter in response thereto. Accordingly, the letter counter will be reset to zero at a time interval $\alpha$ after the leading edge of the reference signal is detected and, hence, be ready for the next print cycle to be commenced.

Turning next to FIG. 7*b*, control circuitry for controlling energizing and deenergizing of the DC motor 1 is depicted. Specifically, a STOP signal is applied to the DC motor control circuitry of the type illustrated in FIG. 2*b*, at a time interval $\gamma$ after the leading edge of the reference signal is detected. The interval between the leading edge of the reference signal and the application of the STOP COMMAND signal to the motor is defined as a $\gamma$-time interval, and an appropriate motor driving control signal $\overline{Q}_6$ is obtained by the use of a $\gamma$-time counter 82. Specifically, when the letter counter 81 is indexed to a count of 13, by the leading edge of the reference signal, flip-flop $FF_5$ is reset, thereby permitting a clock signal, produced by an astable multi-vibrator to be applied to the $\gamma$-time counter 82, for a $\gamma$ time interval. At the end of the $\gamma$ time interval, the $\gamma$-time counter 82 will apply an output signal $C_{out\text{-}2}$ to the reset terminal of control flip-flop $FF_6$ to thereby reset same and produce a HIGH level motor drive signal $\overline{Q}_6$, which signal will deenergize and, hence, brake the operation of the DC motor 1. Accordingly, the control circuitry depicted in FIG. 7*b* will insure that the DC motor is deenergized, at a time interval $\gamma$ after the leading edge of the reference signal is produced. It is noted that the stop signal for controlling the operation of the motor can also be produced by permitting the letter counter 81 to detect the fourteenth (14th) or fifteenth (15th) pulse produced by the detector.

Reference is further made to FIG. 7c, wherein circuitry for terminating the print cycle, at a time interval $\beta$, after a STOP COMMAND signal is produced, is depicted. To this end, a flip-flop $FF_7$, an NAND gate 71 and an $\beta$ time counter 84 are provided for controlling a flip-flop $FF_8$ to produce a print cycle termination pulse $Q_8$. Specifically, at the end of the $\alpha$-time interval, the signal $C_{out-2}$ is applied to flip-flop $FF_7$ to reset same and thereby generate a HIGH level gating signal at the output $\overline{Q}_7$ thereof, which signal is applied to a first input of NAND gate 71. In response to the HIGH level input $\overline{Q}_7$ applied to NAND gate 71, NAND gate 71 will effect a gating of the clock signal to the $\beta$-time counter 84. At the end of the $\beta$-time interval, the $\beta$-time counter will apply a reset pulse to the flip-flop $FF_8$ to thereby produce a signal representative of the end of the print cycle.

It is noted that the instant invention is therefore characterized by the use of a detection assembly and control circuitry that completes each of the control functions in a print cycle in a shorter interval of time after completion of the printing operation to thereby ready the printer for the next print cycle. Although the control circuitry, depicted in FIGS. 7a, 7b and 7c, utilizes the signal produced after each of the character selection timing signals are produced, as the reference timing signal, the instant invention is not limited to a requirement that the reference signal be produced following the production of the last character selection timing signal. Additionally, although the detecting assembly 32 is illustrated as including a detecting plate, photo diode and photo transistor, a magnetic detector or other type optical detector can be utilized. Moreover, in addition to providing a more accurate and faster print cycle by utilizing the detection and control arrangement, illustrated in FIGS. 5 through 7c, it is noted that the same detection and control arrangement can also be utilized to effect a changing over of ribbons or to control a paper feeding electro-magnetic assembly.

Figure 8A:
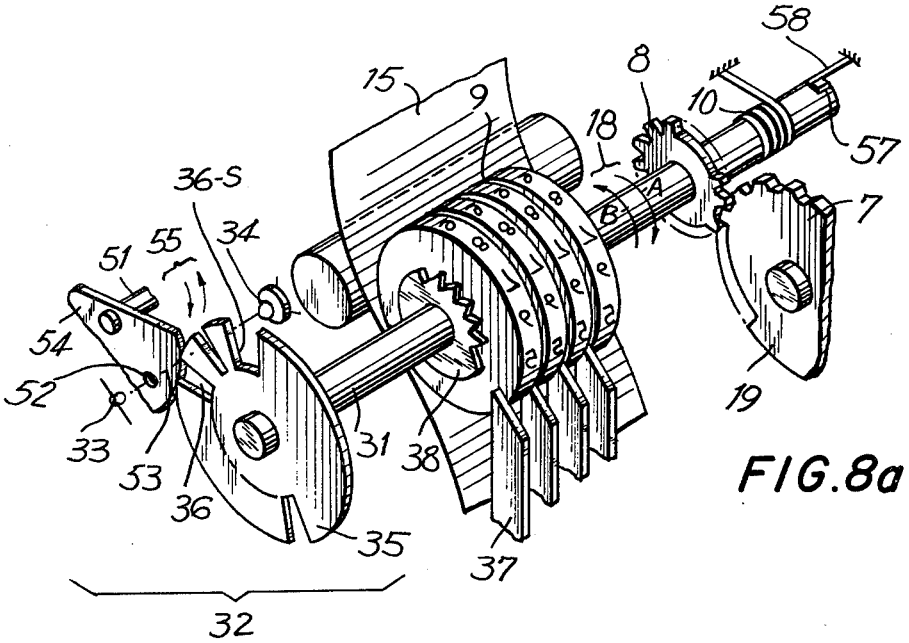
FIG. 8*a* is a perspective view of a miniaturized printer having a detection arrangement constructed in accordance with an alternate embodiment of the instant invention.
Figure 8B:
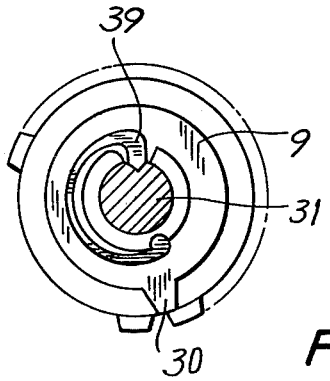
FIG. 8*b* is an elevational view of the print ring assembly of the miniaturized printer depicted in FIG. 8*a;*

Reference is now made to FIGS. 8a, 8b, 9, 10a and 10b, wherein a further printer detection and control arrangement, constructed in accordance with a further embodiment of the instant invention, is depicted, like reference numerals being utilized to denote like elements detailed above. With particular reference to FIG. 8b, when shaft 31 is rotated by the rotation of intermittent driven gear 8, the rotation of the print rings is assured by the use of a flat resilient spring 39 disposed in a notch formed in shaft 31. The detecting plate 35 is provided with a plurality of slits 36, corresponding to the positions of the print characters disposed on the print rings, with a further wider slit 36-S that is positioned to produce a reference timing signal representative of the stand-by position of the printer. Accordingly, the position of the slit 36-S is substantially independent of the position of the print characters disposed on the print rings. As in the embodiment detailed above, after printing is completed, the intermittent driven gear 8 clears the intermittent driving gear 7, to thereby permit a return of each of the print rings 9 to a rest position, by a rotation of the shaft 31 in the direction B indicated by the arrows 18. As illustrated in FIG. 8b, each of the print rings is provided with a stop tooth 30, that will abut the selection pawl 37 to position the print rings in a stand-by position or rest position at the end of each print cycle. As in the embodiment detailed above, the paper feeding mechanism effects an advancement of the paper web, after printing is completed. Once printing is completed, the print rings are returned to a stand-by condition by means of a spring 39 and the rotation of the shaft 31, supporting each of the print rings. A projection 57 is formed on the shaft 31 and engages a stopper 58, secured to the frame of the printer, in order to prevent the shaft from rotating beyond the stand-by or rest position. It is noted, however, that occasionally the projection 57, on the shaft 31, will engage the stopper 58 and result in a bouncing of the shaft in the opposite rotational direction. In order to insure that the reference signal S is detected, and that the first character selection signal $T_0$ is not inadvertently generated as a result of the bouncing effect caused by a return of the shaft, the distance between the standby condition and the position of the first slit, represented by the character signal $T_0$, is selected to be sufficiently wide as to insure that a character selection signal $T_0$ is not inadvertently produced as a result of a bouncing of the shaft when the print rings are returned to a rest position.

As is illustrated in the wave diagram depicted in FIG. 9, the character selection timing signal is comprised of pulses $T_0$ through $T_{12}$, which signals are produced by the slits 36 in the detection plate 35, and represent the positions of the print characters disposed on the print rings. Additionally, a reference signal S, representative of a stand-by condition, is produced by the slit 36-S, and is generated during the return portion of the print cycle after printing has been completed.

The detection and control arrangement, illustrated in FIG. 8a, eliminates the return signals R generated by the photo detection arrangement when the print rings are returned from a print position to a rest position, by the use of a shielding plate 51, including a solid portion 53 and an optical opening 52 therein. Specifically, the optical opening 52 permits optical transmission to be effected between the photo transmission element 33 and the photo detector 34 when the printer is in a stand-by condition, and when the character selection signals $T_0$ through $T_{12}$ are being produced. However, the shielding plate 51 is rotatably displaced in the direction 55 to permit the solid portion 53 thereof to optically block the transmission of the signals when the return signals R are generated. The displacement of the opening 52 in the shield into and out of optical alignment with the photo detector is effected by a camming portion 54 and permits the opening 52 to be disposed in optical alignment with the photo transistor when each of the print rings are aligned at a rest position, at which time the slits 36-S will be disposed in optical alignment with the photo transistor, to thereby produce the reference signal S.

Figure 10A:
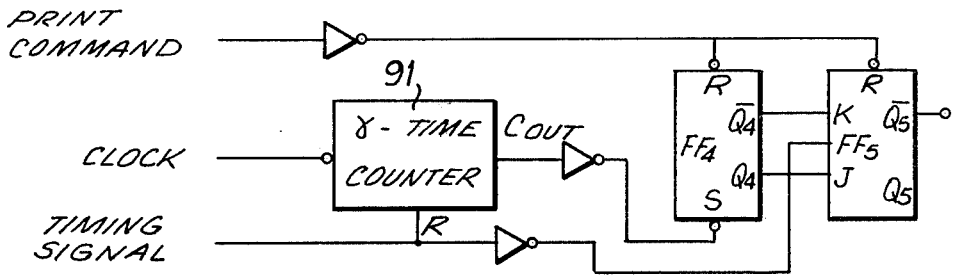
FIGS. 10*a* and 10*b* illustrate control circuitry for use with the miniaturized printer depicted in FIG. 8*a;*

Reference is now made to FIG. 10a, wherein control circuitry for detecting the end of each printing cycle and for controlling the deenergization of the DC drive motor 1, is depicted. The slit 36-S is disposed on the detecting plate 35 at a distance from the slit that produces the pulse $T_{12}$. Accordingly, a $\gamma$-time counter 91, having a time interval larger than the time interval $\alpha$, between the respective character selection pulses $T_0$, $T_1$, $T_2$, etc., is provided. The $\gamma$-time counter 91 receives a clock signal produced by an astable multi-vibrator and, in the absence of any character selection timing signals being applied to the reset terminal thereof, produces a $\gamma$-time interval signal $C_{out}$ at a $\gamma$-time interval after the last character selection timing signal $T_{12}$ is produced. The signal $C_{out}$ is applied to the set terminal S of a flip-flop $FF_4$ and thereby sets the output $Q_4$ to a HIGH level. When the output of the flip-flop $FF_4$ is referenced to a HIGH level, the respective inputs of the JK flip-flop $FF_5$, which inputs are respectively coupled to the output terminals $Q_4$ and $\overline{Q}_4$ of flip-flop $FF_4$ are referenced to a HIGH and LOW level, respectively. Accordingly, upon the application of the leading edge of the next character selection signal, which is the stand-by reference signal S produced by the slit 36-S in the detection plate 36, the flip-flop $FF_5$ applies a deenergization signal to the DC motor to deenergize same in the manner detailed above. Moreover, if the next PRINT COMMAND signal is applied after the leading edge of the standby reference signal S is detected, the PRINT COMMAND signal will reset the JK flip-flop $FF_5$ and, hence, immediately energize the DC motor to begin the next print cycle. This condition is illustrated in FIG. 9, by the dotted lines illustrating the production of timing signals in the event that a PRINT COMMAND signal is applied to the control circuitry once the printing cycle is completed. Alternatively, the stand-by reference signal S will maintain the printer is a deenergized condition until the next print COMMAND SIGNAL is applied thereto.

Figure 10B:
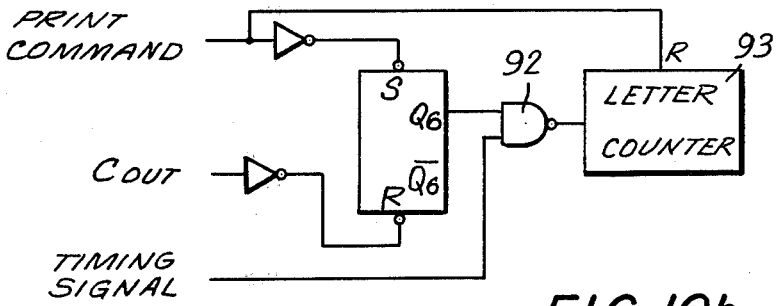

Reference is also made to FIG. 10*b*, wherein a control circuit for synchronizing the print characters circumferentially disposed on the print rings with the character selection timing signals, produced by the detection plate 35, is illustrated. Specifically, the signal $C_{out}$, produced by the $\gamma$-time counter 91 is applied to the reset terminal of flip-flop $FF_6$ to thereby reset same and apply an inhibit signal to the NAND gate 92. Thereafter, character selection timing signals will not be applied to the letter counter 93 until the next PRINT COMMAND signal is applied to the reset terminal R of the letter counter 93, to thereby reset same. Additionally, the PRINT COMMAND signal is applied to the set terminal S of the flip-flop $FF_6$, to thereby apply a gating signal to the NAND gate 92 and permit the character selection timing signals, representative of the character position of the print rings. to be applied to the letter counter 93. Accordingly, the $\gamma$-time counter 91 is utilized to measure a $\gamma$-time interval after which the character selection signals are prevented from being applied to the letter counter 93 until the next PRINT COMMAND signal is applied thereto. If, for any reason, the printer should be stopped at an arbitrary position, the circuitry depicted in FIG. 3*b* insures that the print characters will be synchronized with the character selection signals produced thereby, and the control circuitry, depicted in FIG. 10*a*, insures that the motor will not be energized until the stand-by signal S is applied thereto.

Figure 11:
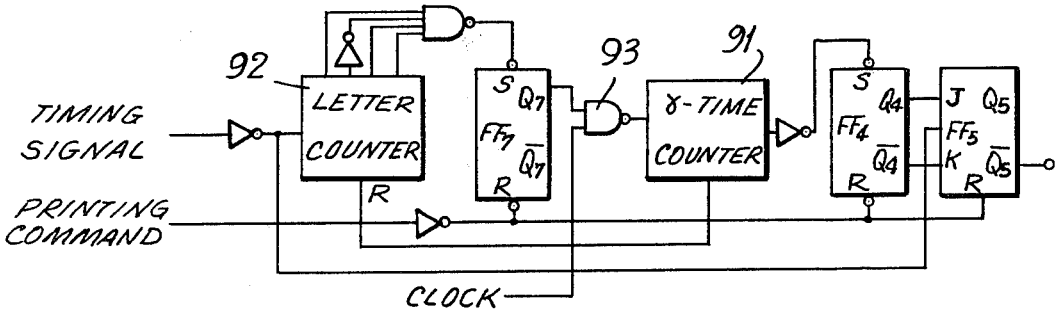
FIG. 11 is a block circuit diagram of control circuitry constructed in accordance with still a further embodiment of the instant invention.

Reference is now made to FIG. 11, wherein a control circuit for detecting a secondary reference signal S' by utilizing a $\gamma$-' time counter to measure an interval of time after each of the respective character selection timing signals $T_0$ through $T_{12}$ have been generated, is provided. It is noted that the drive motor is energized simultaneously with the generation of the PRINT COMMAND signal. The secondary reference signal S' can therefore assure that a $\gamma'$ time interval corresponding to $\gamma'$ in FIG. 9, that is smaller than the $\gamma'$ time interval, can be utilized. The control circuitry, depicted in FIG. 11, receives each of the character selection timing signals after being reset by the PRINT COMMAND signal. However, once the letter counter reaches a predetermined count, such as twelve, the flip-flop $FF_7$ will be set, to thereby permit a clock signal to be gated through NAND gate 92 to the $\gamma'$ time counter to thereby measure a $\gamma'$ time interval. Thereafter, the $\gamma$-' time interval operates in the same manner noted above with respect to the control circuitry, depicted in FIG. 10*a*. Nevertheless, this arrangement assures that the $\gamma$-' time interval will be measured after the occurrence of the twelfth pulse, and hence will assure that the first group of signals, produced by the detection plate 35, is discriminated from a second group of signals such as the reference signal S. The control circuitry depicted in FIGS. 10*a* and 11, improve control of the energization and deenergization of the DC motor, and synchronize same with the printing cycle to thereby permit successive printing cycles to be immediately commenced upon the end of each previous print cycle.

Reference is also made to FIGS. 12*a* and 12*b*, wherein a printer, constructed in accordance with a further embodiment of the instant invention, is depicted. Specifically, in the embodiment depicted in FIG. 12*a*, the shield plates 51, discussed in detail above, can be eliminated. Instead, the detecting plate 35 is provided with a plurality of slits 36 representative of each of the print character positions and a further slit 36-S, for generating a reference signal S representative of the return of the print rings to a rest position. The initial, or beginning, of the return process is substantially equal to the time of the printing operation, and accordingly instead of the shield being provided, the detection plate is absent any slits that can be detected after printing until the slit 36-S is detected.

As is illustrated in FIG. 12*b*, a spring 63 having a first end secured to a hook portion 62 of the print ring 9 and a further end secured to a stationary plate 61, secured to the shaft 31, causes the pring ring 9 to be rotated by the spring 63 when the shaft 31 is rotated. Accordingly, each of the character selection timing signals $T_0$ through $T_{12}$ correspond to the slits 36 and will be generated in the usual manner. However, when all of the print rings are stopped, the spring 63 is wound by the shaft 31 and when the printing operation is completed and the print rings are no longer in a locked position, the print rings will again be rotated in the same direction as they were when the print rings were rotated from a rest position to a print position by the spring 63. Accordingly, no return signals R will be produced as each of the print rings are rotated in the same direction to a stand-by condition. Moreover, the slit 36-S will be positioned on the detection plate at a position representative of the stand-by condition of the printer, to thereby produce a reference signal indicating that the print cycle is substantially over and that the DC motor should be deenergized. It is apparent that such an arrangement eliminates the necessity of providing a shield plate of the type detailed above.

Reference is finally made to FIG. 13, wherein a further coupling arrangement for the print ring 9 to the shaft 31, by means of a friction spring 39, is depicted. Specifically, spring 39 is a flat spring and has an end thereof disposed in friction engagement with the shaft 31. For the print ring arrangement, illustrated in FIG. 13, it is necessary to rotate the print ring 31 two complete revolutions for each print cycle. A first revolution is completed during the selection process and a second revolution is completed during the portion of the print cycle when each of the print rings are being returned to a rest position. The embodiment depicted in FIG. 13 reduces the cost of the printer by permitting the coil spring 10 to be eliminated and the shield plate 51 is not needed to effect a blocking of the return signal. Accordingly, the embodiments depicted in FIGS. 12*a*, 12*b* and 13 provide the same increased speed, efficiency and simplify the printer in the same manner as the embodiment detailed above.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a printer including a plurality of print rings having print characters circumferentially disposed therearound, said print characters being selectively positioned in a print position by rotation of each of said print rings in a first rotational direction from a stand-by position to a print position during a print cycle and rotational drive means including motor means adapted, in response to being energized, to rotatably drive said print rings at least from said stand-by position to said print position during each print cycle, the improvement comprising a detection means including a single detector and a single detection plate means for detecting the rotary position of said print rings, said single detector generating a character selection timing signal representative of each of the rotational positions of said print rings, said rotational positions of said print rings corresponding to a print character circumferentially disposed about said print rings, said single detection plate means rotating in coordination with said print rings relative to said single detector, print selection means associated with each of said print rings for selectively positioning each of said print rings at respective predetermined print positions during each print cycle, in response to said character selecting timing signal produced by said single detector being applied thereto, said single detector being further adapted to generate a reference timing signal that is distinct in wave form from said character selection signal, said reference timing signal being generated after all said print rings are at said respective predetermined positions, during each print cycle, and further comprising means for deenergizing and braking said motor means in response to said reference timing signal being generated by said single detector.

2. A printer as claimed in claim 1, wherein said character selection timing signal is a series of similar pulse signals representative of each of said rotational positions of said print rings, and said detection means includes control circuit means adapted to measure a predetermined time interval greater than the time interval between each of said pulses in said character selection time signal and in response to detecting said predetermined time interval and receiving said reference timing signal, said control circuit means applying a deenergizing signal to said deenergizing means for deenergizing said motor means to effect a braking of said motor means.

3. A printer as claimed in claim 2, wherein said single detection plate has a first plurality of equally sized openings formed therein at equal distances with respect to each other, and a further opening that is larger than said first plurality of openings, and said detection means further includes single photo detection means for producing the pulses of said character selection timing signal in response to said first plurality of openings being detected thereby, and for producing said reference timing signal in response to said larger opening being detected thereby.

4. A printer as claimed in claim 3, wherein each of said plurality of openings is positioned in said detecting plate to correspond to a position of said print characters disposed around said print ring so that said photo detection means detect the alignment of each of said openings with said photo detection means, when said print rings are rotated from a stand-by position to a print position.

5. A printer as claimed in claim 4, wherein said enlarged opening in said detection plate is positioned to be in alignment with said photo detection means after each of said print rings are selectively positioned in a print position.

6. A printer as claimed in claim 4, and including a shielding plate being displaced intermediate said photo detection means and said detection plate to prevent said photo detection means from detecting the alignment of said plurality of openings in said detecting plate as the print rings are returned from a print position to a stand-by position.

7. A printer as claimed in claim 6, wherein said enlarged opening is representative of a stand-by position, said shielding plate being adapted to be displaced out of optical alignment with said photo detection means and said openings in said detection plate, to thereby permit said stand-by reference timing signal to be detected by said photo detection means when said enlarged opening is aligned with said photo detection means, said control circuit means in response to said reference signal being applied thereto, applying said deenergization signal to said motor to effect a braking of said motor.

8. A printer as claimed in claim 2, wherein said control circuit means includes a first time interval means for detecting an interval of time after the last pulse of said character selection signal is applied, said interval of time being greater than the interval of time between any of the pulses of said character selection timing signal, and in response thereto, producing a control signal, and a switching means for receiving said control signal and said reference timing signal, said switching means in response to said reference timing signal being received thereby following said control signal being received thereby, being adapted to apply said deenergization signal to said motor means.

9. In a printer including a plurality of print rings having print characters circumferentially disposed therearound, said print characters being selectively positioned in a print position by rotation of each of said print rings in a first rotational direction from a stand-by position to a print position during a print cycle and rotational drive means including motor means adapted, in response to being energized, to rotatably drive said print rings at least from said stand-by position to said print position during each print cycle, the improvement comprising a detection means including a single detector for detecting the rotary position of said print rings and for generating a character selection timing signal representative of each of the rotational positions of said print rings, said rotational positions of said print rings corresponding to a print character circumferentially disposed about said print rings, print selection means associated with each of said print rings for selectively positioning each of said print rings at respective predetermined print positions during each print cycle, in response to said character selecting timing signal produced by said detection means being applied thereto, said detection means being further adapted to detect the rotary positions of said print rings and to generate a reference timing signal that is distinct in wave form from said character selection signal during each print cycle and deenergizing means for deenergizing and braking said motor means in response to said reference timing signal being generated by said detection means, said character selection timing signal being a series of similar pulse signals representative of each of said rotational positions of said print rings, and said detection means includes control circuit means adapted to measure a predetermined time interval greater than the time interval between each of said pulses in said predetermined time interval and receiving said reference timing signal, said control circuit means applying a deenergizing signal to said deenergizing means to effect a braking of said motor means, said detection means being mechanically coupled to said print rings and said control circuit means including letter counter means for detecting each pulse of said character selection timing signal to thereby effect synchronization between the rotary position of said print rings and the pulses of said character selection timing signal produced by said detection means.

10. A printer as claimed in claim 9, wherein said letter counter means is adapted to produce a first control signal in response to all of said pulses of said character selection timing signal and said reference timing signal being applied thereto, said control circuit means also including time interval counter means for producing a second control signal at a predetermined time interval after said reference timing signal is applied to said letter counter means, said second control signal being applied as said deenergizing signal to said drive motor to effect a deenergization of said drive motor.

11. A printer as claimed in claim 10, and including a second time interval counter means for measuring a time interval that is larger than the time interval of each of the pulses of said character selection signal and is less than the predetermined time interval of said reference timing signal for applying a third control signal to said letter counter means to reset said letter counter means to a starting count for commencement of the next printing cycle.

12. A printer as claimed in claim 11, and including a third time interval counter means for receiving the second control signal received by said first time interval counter means, and in response thereto, for producing an end of print cycle control signal at a predetermined interval of time after said second control signal is applied thereto in order to permit said next print cycle to be commenced.

* * * * *